US005746346A

United States Patent [19]

Crilly

[11] Patent Number: 5,746,346

[45] Date of Patent: May 5, 1998

[54] PAINT CARRIER

[76] Inventor: Thomas G. Crilly, 8 Marian TCE, Slane, Co. Meath, Ireland

[21] Appl. No.: 783,690

[22] Filed: Jan. 15, 1997

[51] Int. Cl.[6] ..... B65D 91/00

[52] U.S. Cl. ..... 220/736; 220/23.83; 220/695

[58] Field of Search ..... 220/736, 555, 220/23.83, 23.86, 23.4, 695

[56] References Cited

U.S. PATENT DOCUMENTS

| | | | |
|---|---|---|---|
| 482,082 | 9/1892 | Deming et al. | 220/736 X |
| 2,827,648 | 3/1958 | Geisz | 220/695 X |
| 2,988,767 | 6/1961 | Tretwold et al. | 220/695 X |
| 3,385,465 | 5/1968 | Bliss | 220/23.83 X |
| 3,389,830 | 6/1968 | Smith | 220/23.4 X |
| 4,834,253 | 5/1989 | Crine | 220/23.83 X |
| 4,993,767 | 2/1991 | Song | 220/736 X |
| 5,186,329 | 2/1993 | Fogelberg | 220/555 X |

*Primary Examiner*—Steven M. Pollard

*Attorney, Agent, or Firm*—O'Connell Law Firm

[57] ABSTRACT

A paint carrying receptacle and paint carrying device for transporting a multiplicity of paints within a cohesive, compartmented arrangement while maintaining the paints separate pending their application. The receptacle has a generally planar first side wall, a generally planar second side wall, an arcing third side wall, and a bottom wall all mutually sealingly engaged to form a liquid-tight wedge of a cylinder whereby a multiplicity of similar receptacles may be juxtaposed to for a generally cylindrical receptacle arrangement. The receptacles may approximate selected wedges of a cylinder such as one-half, one-third, or one-quarter cylinders. The paint carrying device has a bottom wall, at least one side wall sealingly engaged with and extending upwardly from the perimeter of the bottom wall, and at least one irremovable and sealingly engaged dividing wall for dividing an inner volume of the device into at least two permanently separate compartments. The receptacle and carrying device may include corrugated lips for removing excess paint from a paint brush and C-shaped members for releasably retaining paint brushes.

18 Claims, 4 Drawing Sheets

PAINT CARRIER

FIELD OF THE INVENTION

The present invention relates to the field of painting. More particularly, it relates to a receptacle and carrying device for transporting a multiplicity of paints within a cohesive, compartmented arrangement while maintaining the paints separate pending their application.

BACKGROUND OF THE INVENTION

Rarely does a painter work with just a single paint. Instead, multiple colors and types of paints normally are required for completing each painting job. It is elementary that the paints must be kept separate pending their application. Consequently, it is necessary for paints to be distributed in individual containers or cans. As a result, applying a number of different paints requires an equivalent number of individual cans, each holding a single color or type of paint.

By necessity, at least some amount of each paint must be transported to its area of application. For example, a painter seeking to paint the elevated portions of a home must somehow transport the paint which is to be applied up a ladder or the like to its area of application. Two options are available for effecting the required movement of the multiplicity of paints: a multiplicity of trips carrying a single can of paint each time or a single trip attempting to carry a multiplicity of paint cans. The former option lacks convenience, the latter safety. With regard to safety, it is evident that those hoping to climb a ladder with three and even four cans may be forced to forego holding the ladder for stability; both hands must be used to hold the paint cans. Furthermore, having a number of paint cans stored at the top of a ladder or on scaffolding causes the cans to be difficult to access and to be obstacles to the painters' free movement. Further still, carrying a whole can of a paint when just a small amount is needed, as with trim and windows, is unduly burdensome.

With these and other disadvantages of the prior art in mind, it becomes clear that there is a need for a means for carrying a multiplicity of paints within a cohesive, compartmented arrangement while maintaining the paints separate pending their application.

SUMMARY OF THE INVENTION

Advantageously, the present invention has as its principal object that of enabling a painter to carry a multiplicity of paints within a cohesive, compartmented arrangement while maintaining those paints separate pending their application.

An incidental object of the instant invention is to improve the safety of painters who attempt to transport a multiplicity of paints by supplying a cohesive, compartmented arrangement that is able to contain a multiplicity of paints separately whereby the need for carrying multiple cans simultaneously is avoided.

Another object of the invention is to minimize the number of trips required to transport paints to their area of application by permitting a painter to transport a multiplicity of paints simultaneously in a single arrangement.

Yet another object of the invention is to permit each paint receptacle to be removed and replaced selectively to permit individual filling, cleaning, replacement, and substitution.

Still further objects of the invention are to permit easy accessibility to a multiplicity of paints by retaining them in a single arrangement, to reduce the clutter presented by a multiplicity of paint cans, and to allow a painter to transport only the approximate amount of paint necessary for performing a task at hand.

From this specification, these and other objects and advantages of the present invention will become obvious to those skilled in the art. In carrying out the aforementioned objects, the invention may assume a multiplicity of embodiments. Although the receptacles are intended for use in combination, the invention includes receptacles singly or grouped in a kit form. In any event, the receptacle is comprised most basically of a liquid-tight, less-than-one-half wedge of a cylinder whereby a multiplicity of similarly wedge-shaped receptacles could be juxtaposed to create a generally cylindrical, compartmented receptacle arrangement with each receptacle comprising a compartment, each receptacle being capable of retaining a paint separately, and each receptacle being capable of being removed selectively from the arrangement. Permitting the selective removal of each receptacle allows for the refilling, cleaning, substitution, and rearrangement of the receptacles individually. The receptacles may be designed to join together by such means as a clip to form a cohesive arrangement, or they may be held in a cohesive arrangement by an external means such as by being juxtaposed within a cylindrical carrying unit such as an empty paint can or a common bucket.

It may be advantageous to include a means attached to the receptacle for releasably retaining a paint brush. For example, there may be a C-shaped member by which the handle of a paint brush may be held. Also useful might be a corrugated lip for removing excess paint from a paint brush. Still further, it would be useful if each receptacle was possessed of a handle to ease the selective removal of that receptacle from the receptacle arrangement. For adaptability, receptacles may be constructed to comprise varying wedge portions of a cylindrical receptacle arrangement. For example, receptacles may comprise one-half, one-third, and/or one-fourth portions of a cylinder.

Although a receptacle arrangement comprised of individual receptacles is advantageous for a multiplicity of reasons, it is within the scope of this invention to craft a substantially unitary, compartmented carrying device that accomplishes many of the aforementioned objects. For example, there may be a device with an open inner volume divided into at least two permanently separate, liquid-tight compartments. The device may be cylindrical in shape. It may have a single dividing wall that traverses a center axis of the device to form a device having two permanently separate, liquid-tight compartments. Alternatively, there may be three dividing walls for creating three permanently separate, liquid-tight compartments. It is also contemplated that there may be four dividing walls for forming four permanently separate, liquid-tight compartments.

The foregoing discussion broadly outlines the more important features of the invention to enable a better understanding of the detailed description that follows and to instill a better appreciation of the invention's contribution to the art. Before an embodiment of the invention is explained in detail, however, it must be made clear that the following details, descriptions, and illustrations are merely exemplary of a few possible manifestations of the invention; many other manifestations are possible and will become obvious to one skilled in the art upon reading this disclosure.

DETAILED DESCRIPTION OF PREFERRED EMBODIMENTS

This detailed description is directed to a means for carrying a multiplicity of paints within a cohesive, compartmented arrangement while maintaining them permanently separate pending their application. The description sets forth, by way of example, a group of particularly preferred embodiments which the invention might take with illustrative referencing to the included drawing figures.

Figure 1:
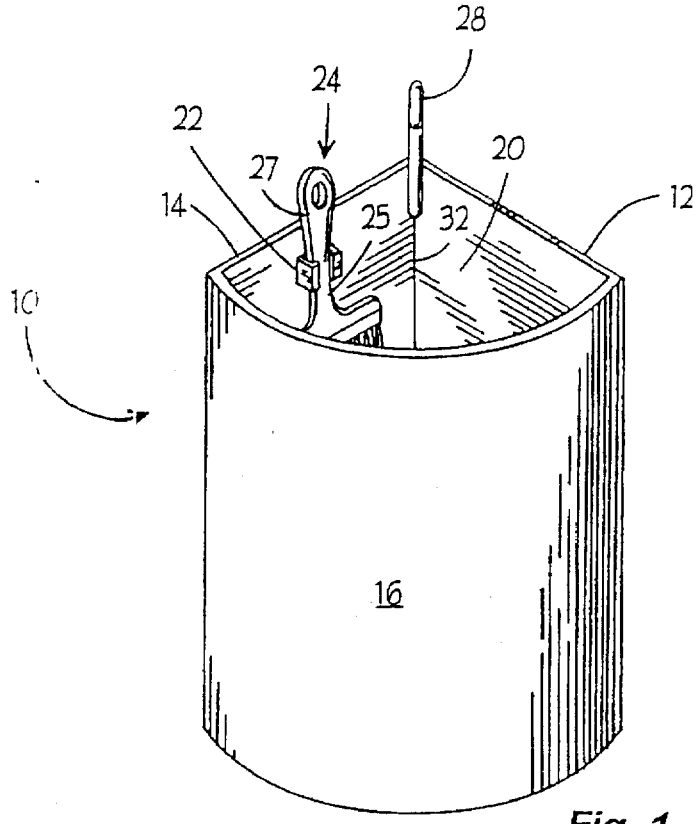
FIG. 1 is a perspective view of a receptacle embodying the present invention.
Figure 2:
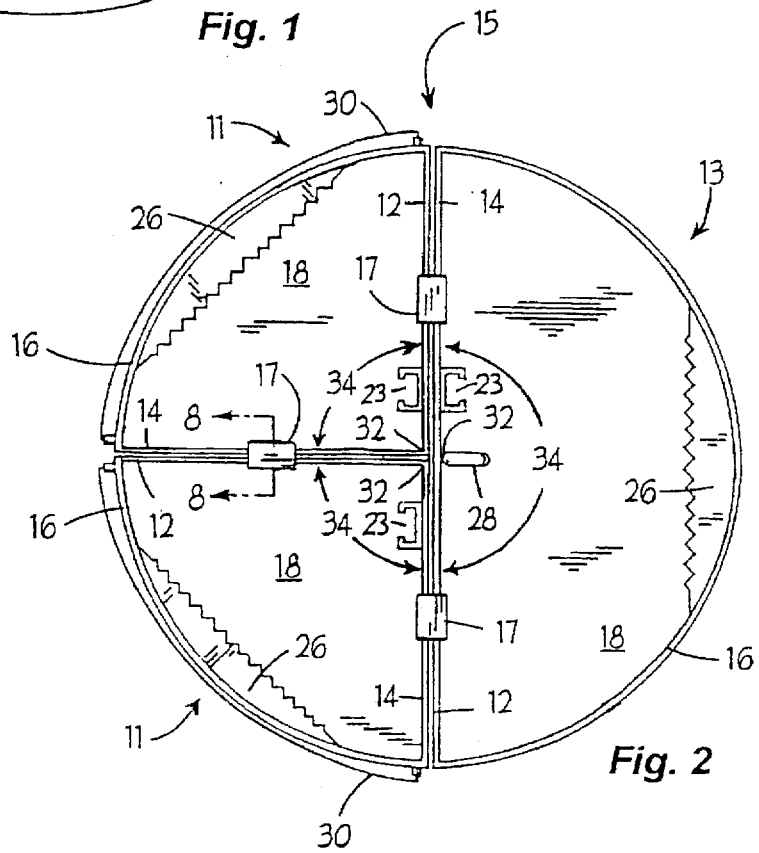
FIG. 2 is a plan view of a cohesive receptacle arrangement embodying the present invention.
Figure 3:
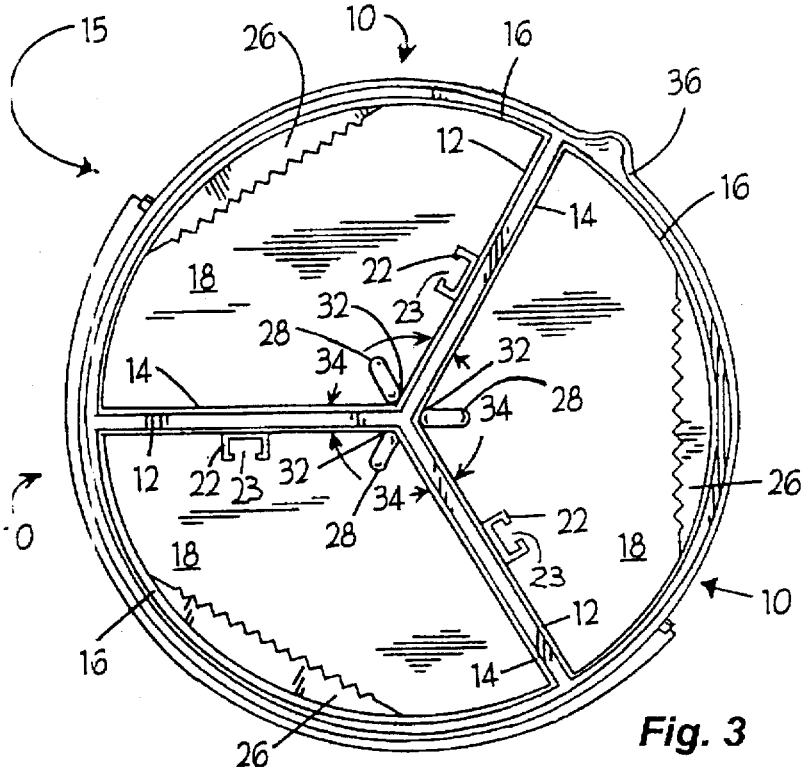
FIG. 3 is a plan view of a receptacle arrangement embodying the present invention within a cylindrical carrying unit.

Referring to FIGS. 1, 2, and 3, there are shown individual receptacles 10, 11, and 13. Each receptacle 10, 11, and 13 is designed for use in combination with at least one similar receptacle 10, 11, and/or 13 to form a receptacle arrangement such as that indicated generally at 15 in FIGS. 2 and 3. Each receptacle 10, 11, and 13 is comprised of a generally planar first side wall 12, a generally planar second side wall 14, an arcing third side wall 16, and a bottom wall 18. The walls 12, 14, 16, and 18 are mutually sealingly engaged to create substantially liquid-tight receptacles 10, 11, and 13, each having a top opening 20. Preferably, in each receptacle 10, 11, and 13 the first side wall 12 and the second side wall 14 converge to join at a joint 32 at an angle 34 of 180 degrees or less. As a result, each receptacle 10, 11, and 13 comprises a wedge-shaped, less-than-one-half portion of a receptacle arrangement 15, and a multiplicity of similar receptacles 10, 11, and/or 13 may be juxtaposed to form a generally cylindrical receptacle arrangement such as that shown at 15.

Most advantageously, the numerical value of the angle 34 enters 360 approximately a whole number of times whereby at least two receptacles 10, 11, and/or 13 may be juxtaposed to create a substantially complete, compartmented, and cylindrical receptacle arrangement 15. In FIGS. 1 and 3, the receptacle 10 has an angle 34 of approximately 120 degrees such that, knowing 360 divided by 120 to equal three, three similar receptacles 10 could be juxtaposed to form a cylindrical receptacle arrangement 15. Similarly, looking to FIG. 2, one sees a receptacle 11 having an angle 34 of 90 degrees such that, knowing 360 divided by 90 to equal four, four similar receptacles 11 could be juxtaposed to create a cylindrical receptacle arrangement. FIG. 2 depicts another receptacle 13 having an angle 34 of approximately 180 degrees such that, knowing 360 divided by 180 to equal two, two similar receptacles 13 could be juxtaposed to create a cylindrical receptacle arrangement.

Figure 8:
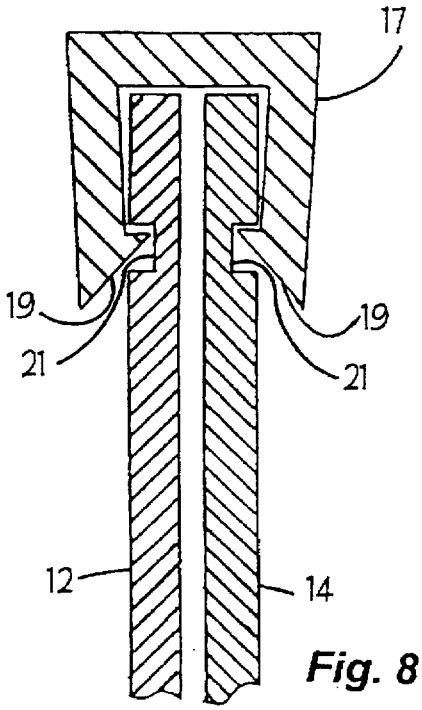
FIG. 8 is a cross-section of the clip arrangement of FIG. 2.

The receptacle 10 includes a hook-shaped handle 28 for lifting the receptacle 10. The handle 28 is fixed to the receptacle 10 at joint 32. However, as is shown in FIG. 2, a bail type handle 30 may be substituted for the hook-shaped handle 28. Each receptacle 10, 11, and 13 also includes a corrugated lip 26 fixed to the arcing third side wall 16 for removing excess paint from a paint brush such as that shown at 24. Furthermore, looking to FIG. 3, a C-shaped member 22 having an open interior 23 for retaining the paint brush 24 is attached to the first side wall 12 or the second side wall 14 of each receptacle 10, 11, and 13. As FIG. 1 illustrates, the C-shaped member 22 is useful for retaining a paint brush 24 which has a distal portion 27 thicker than a proximal portion 25. With such an arrangement, a paint brush 24 may be retained releasably by passing the proximal portion 25 into the open interior 23 of the C-shaped member 22 and lowering the paint brush 24 so that the thick distal portion 27 rests within the C-shaped member 22. Most optimally, as FIG. 8 shows most clearly, the first side wall 12 and the second side wall 14 are generally symmetrical with each having a height which decreases from the joint 32 to the arcing third side wall 16. The added height of the first side wall 12 and the second side wall 14 where the two walls 12 and 14 will be adjacent one another helps to maintain better the separation of paints between the receptacles 10, 11, and/or 13.

A cylindrical receptacle arrangement such as that shown at 15 may be held in a generally cohesive and transportable relationship by being placed within a carrying unit 36, shown in FIG. 3. The unit 36 is shown as a common bucket, but any appropriate container can be used. However, one must note that it is also within the scope of the invention to have the receptacles 10, 11, and 13 adapted to be engaged each other by any suitable means such that a number of receptacles 10, 11, and/or 13 could be juxtaposed to form a generally cylindrical, compartmented arrangement 15 which is held cohesive independently of any single carrying unit 36. For example, in FIG. 2, the receptacles 11 and 13 are held in a cohesive relationship by a number of appropriately placed clips 17. A cross section of the clip 17 arrangement is shown in FIG. 8 wherein the two receptacles 11 are held together by a clip 17 which has tongues 19 that are biased to snap into grooves 21 in the first side wall 12 and the second side wall 14. Under such a construction, each of the receptacles, 10, 11, and/or 13 would have grooves 21 in its first side wall 12 and its second side wall 14 so that clips 17 could be placed as is required for cohesiveness.

Receptacles 10, 11, and/or 13 may be distributed in a kit form wherein the kit might be comprised of a multiplicity of receptacles 10, 11, and/or 13 which may be combined to create a substantially complete, compartmented cylindrical arrangement such as that shown at 15 in FIGS. 2 and 3. Such a kit may include only identical receptacles 10, 11, or 13 in a number only sufficient as that required to form a substantially complete, compartmented cylindrical arrangement such as 15. For example, a kit might include only three identical receptacles 10 which are shown juxtaposed in FIG. 3. In this embodiment, one skilled in the art will appreciate that three different paints can be maintained separately. Each of the receptacles 10 may be removed individually for refill, replacement, or cleaning. However, alternatively a kit may include an assortment of receptacles 10, 11, and/or 13 to enable a user to combine receptacles 10, 11, and/or 13 to suit a particular purpose. For example, a kit might include, among other receptacles 10, 11, and/or 13, a receptacle 13 having an angle 34 of 180 degrees and two receptacles 11 having angles 34 of 90 degrees each whereby the receptacles 11 and 13 could be juxtaposed to create the substantially complete cylindrical receptacle arrangement 15 shown in FIG. 2.

Although employing individual receptacles 10, 11, and/or 13 of the type described above bestows a multiplicity of advantages not found in the prior art, it is also within the scope of the invention to form a compartmented construction designed to be essentially complete in and of itself, without need for combination with other devices. Various embodiments of such a construction are shown in FIGS. 4, 5, 6, and 7 wherein a compartmented paint carrying device is indicated generally at 50. It is contemplated that embodiments of the invention such as those shown in FIGS. 4,5,6, and 7 may be designed to stand alone, or they may be designed to fit within a conventional paint can or other similarly substantially cylindrical object.

Figure 4:
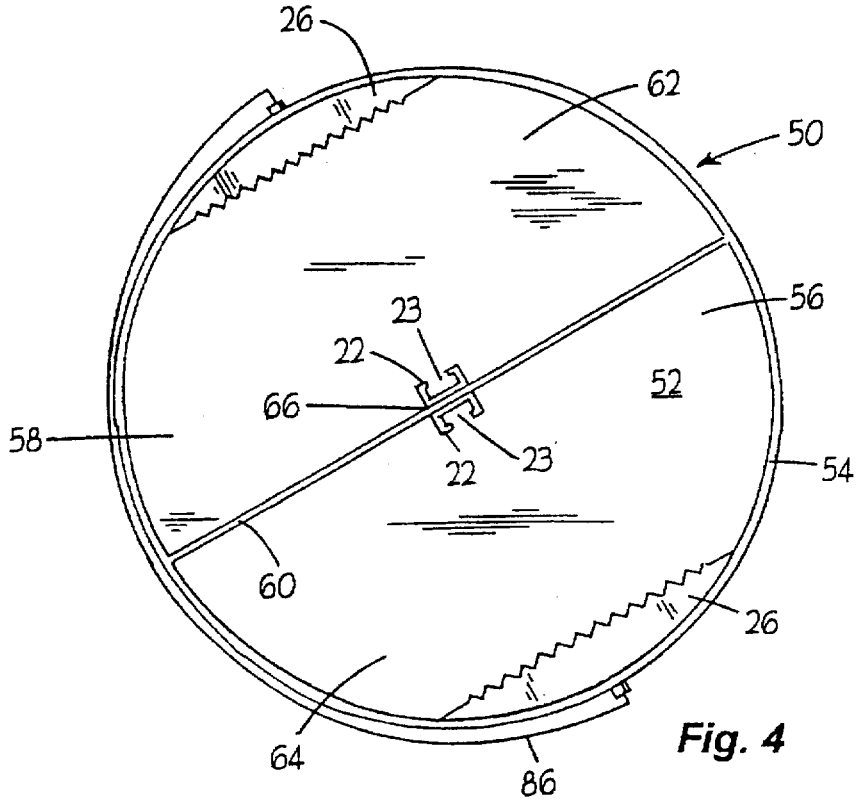
FIG. 4 is a plan view of a compartmented paint carrying device embodying the present invention.

In a most simple form, as is illustrated in FIG. 4, each device 50 comprises a generally rigid container having a bottom wall 52, at least one side wall 54 sealingly engaged with and extending upwardly from the perimeter of the bottom wall 52, a top opening 56, an open inner volume 58, and an irremovable dividing wall 60. In the embodiment of FIG. 4, the bottom wall 52 is generally round and there is only one, generally annular side wall 54 whereby the device 50 is generally cylindrical and the device 50 has a center axis 66. In such a device 50, the dividing wall 60 is generally planar and at least meets with the center axis 66 thereby creating a first compartment 62 and a second compartment 64. Most preferably, the dividing wall 60 has a height that declines downwardly from the center axis 66 to the side wall 54 to better maintain paint separate within the device 50. For ease in lifting the device 50, there is included a bail-type handle 86.

Figure 5:
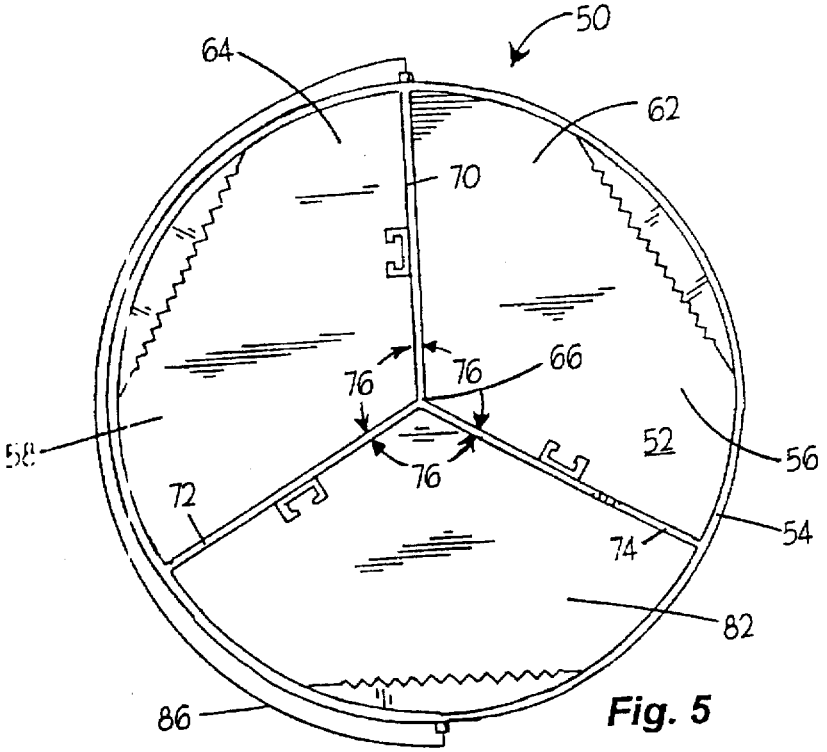
FIG. 5 is a plan view of an alternative device embodying the invention.

FIG. 5 shows a device 50 which has a first irremovable dividing wall 70, a second irremovable dividing wall 72, and a third irremovable dividing wall 74 wherein each dividing wall 70, 72, and 74 is generally planar and extends from the center axis 66 of the device to the at least one side wall at an angle 76 of approximately 120 degrees relative to an adjacent dividing wall 70, 72, or 74 to divide the open inner volume 58 of the device 50 into three equal compartments: first compartment 62, second compartment 64, and third compartment 82, each for retaining a different paint separately. Ideally, the dividing walls 70, 72, and 74 each have a height that declines downwardly from the center axis 66 to the side wall 54 to better maintain paint separate within the device 50. For ease in lifting the device 50, there is included a bail-type handle 86.

Figure 6:
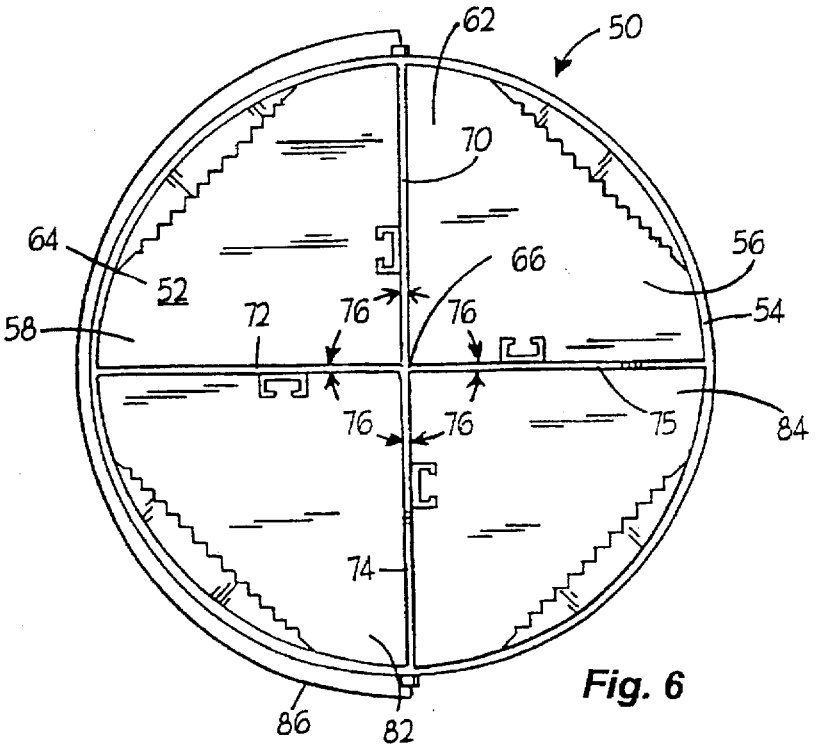
FIG. 6 is a plan view of another device embodying the invention.

FIG. 6 shows a device 50 which has a first irremovable dividing wall 70, a second irremovable dividing wall 72, a third irremovable dividing wall 74, and a fourth irremovable dividing wall 75 wherein each dividing wall 70, 72, 74, and 75 is generally planar and extends from the center axis 66 of the device to the at least one side wall at an angle 76 of approximately 90 degrees relative to an adjacent dividing wall 70, 72, 74, or 75 to divide the open inner volume 58 of the device 50 into four equal compartments: first compartment 62, second compartment 64, third compartment 82, and fourth compartment 84, each for retaining a different paint separately. As with the other embodiments of the invention, ideally the dividing walls 70, 72, 74 and 75 each have a height that declines downwardly from the center axis 66 to the side wall 54 to better maintain paint separate within the device 50. For ease in lifting the device 50, there is included a bail-type handle 86.

Figure 7:
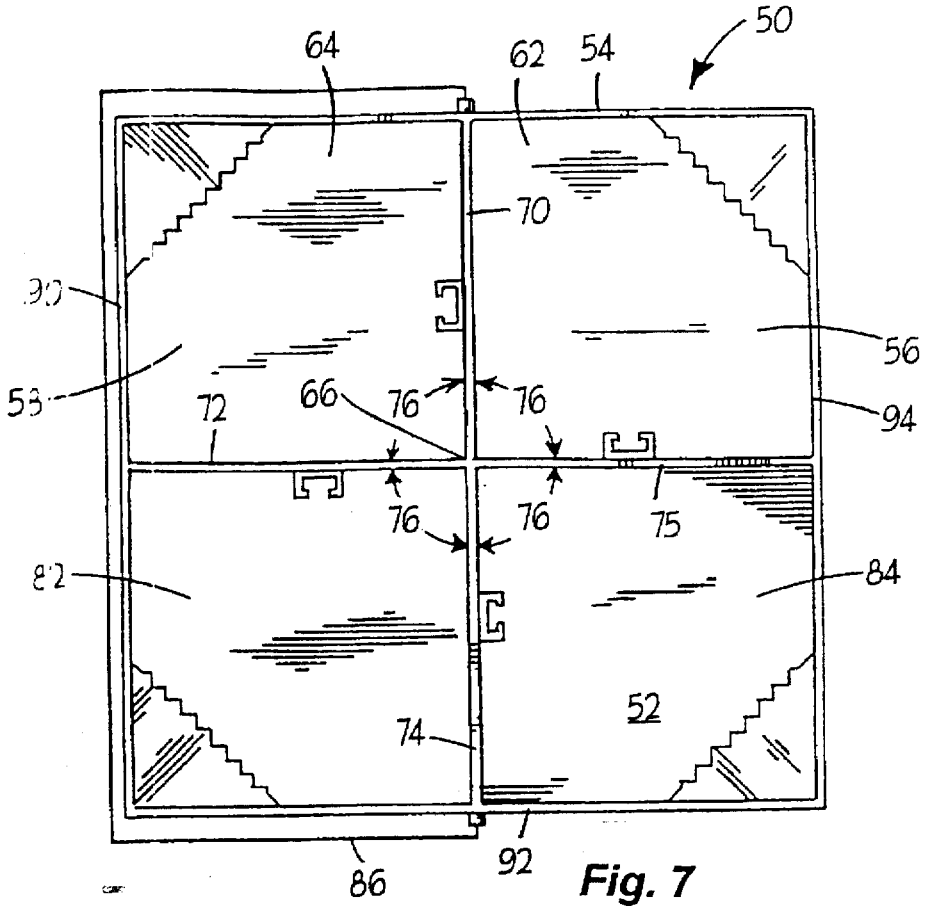
FIG. 7 is a plan view of still another embodiment of the invention.

FIG. 7 illustrates an alternative embodiment of the invention which is similar to that of FIG. 6 in that the open inner volume 58 is divided into four compartments 62, 64, 82, and 84. However, in FIG. 7 the device 50 has four generally planar side walls: first side wall 54, second side wall 90, third side wall 92, and fourth side wall 94. Under this construction, the device 50 has a rectangular shape with four similar rectangular compartments 62, 64, 82, and 84 formed therein, each for retaining a different paint separately. Again, to better maintain paint separate within the device 50, ideally the dividing walls 70, 72, 74 and 75 each have a height that declines downwardly from the center axis 66 to its respective side wall 54, 90, 92, or 94. For ease in lifting the device 50, there is included a bail-type handle 86.

As with the individual receptacles 10, each of the devices 50 shown in FIGS. 4, 5, 6, and 7 includes a corrugated lip 26 in each compartment 62, 64, and, if present, 82 and 84 for removing excess paint from a paint brush such as that shown at 24 in FIG. 1. Likewise, each compartment 62, 64, and, if present, 82 and 84 includes a C-shaped member 22 for releasably retaining a paint brush 24.

From the foregoing, it is apparent that, regardless of the particular embodiment of the present invention one makes use of, many advantages may be enjoyed. By pouring a different paint into each compartment 62, 64, and, if present, 82 and 84 of a device 50 or into each receptacle 10, 11, and/or 13 of an arrangement 15, a painter can carry a multiplicity of paints within a cohesive, compartmented arrangement while maintaining those paints separate pending their application. Furthermore, a painter will be able to carry the arrangement 15 or the device 50 with a single hand thereby improving the safety of ascending a ladder while transporting a multiplicity of paints. Furthermore, by transporting multiple paints as a cohesive arrangement 15 or in a single device 50, a painter may minimize the number of trips required to transport paints to their area of application. Also, each paint receptacle 10, 11, and/or 13 of a receptacle arrangement 15 can be removed and replaced selectively thereby permitting selective filling, cleaning, replacement, and substitution. Still further, multiple paints can be accessed easily within a single arrangement 15 or device 50, and the single arrangement 15 and the device 50 present less clutter than a multiplicity of prior art paint cans. Even further still, by being able to control the amount of paint poured into the receptacles 10, 11, and 13 and the compartments 62, 64, 82, and 84, a painter taking advantage of the present invention can avoid needless work by ensuring that only the approximate amount of paint necessary for performing a task at hand is transported. From this disclosure, these and other advantages will obvious to those skilled in the art.

The foregoing discussion merely sets forth a few possible manifestations of the present invention. Those skilled in the art will appreciate that the invention may take many other forms. Therefore, the claims which follow shall be deemed to include such equivalent constructions insofar as they do not depart from the spirit and scope of the present invention.

What is claimed is:

1. A paint carrying receptacle for use in combination with at least one other similar receptacle for maintaining a multiplicity of paints separate within a compartmented receptacle arrangement, the receptacle comprised of a generally planar first side wall, a generally planar second side wall, an arcing third side wall, and a bottom wall; wherein the first side wall and the second side wall have lengths which are substantially equal; wherein the first side wall, the second side wall, the third side wall, and the bottom wall are mutually sealingly engaged to create a wedge of a cylinder having a top opening wherein the bottom wall comprises a bottom of the receptacle, wherein the first side wall and the second side wall converge to join at a joint at an angle of 180 degrees or less; and wherein the first side wall and the second side wall have heights that decline downwardly to the arcing third side wall from the joint where the first side wall joins the second side wall for better maintaining the separation of paints when a multiplicity of similar receptacles are juxtaposed to form a generally cylindrical receptacle arrangement whereby a multiplicity of similar receptacles may be juxtaposed to form a generally cylindrical arrangement with each receptacle comprising a compartment, each receptacle being capable of separately retaining a paint, and each receptacle being capable of being selectively removed from the receptacle arrangement.

2. The receptacle of claim 1 further comprising a means attached to the receptacle for releasably retaining a paint brush.

3. The receptacle of claim 2 wherein the paint brush retaining means is comprised of a generally C-shaped member having an open interior, the C-shaped member being attached to an interior face of a side wall of the receptacle whereby a paint brush having a handle with a distal portion thicker than a proximal portion may be retained releasably by the C-shaped member by passing the proximal portion of the handle into the open interior of the C-shaped member and resting the distal portion of the handle within the C-shaped member.

4. The receptacle of claim 1 further comprising a corrugated lip attached to an interior face of a side wall of the receptacle for use in removing excess paint from a paint brush.

5. The receptacle of claim 1 further comprising a handle attached to the receptacle for lifting the receptacle.

6. The receptacle of claim 1 wherein the numerical value of the angle upon which the first side wall and the second side wall converge enters 360 approximately a whole number of times greater than one whereby a number of receptacles equivalent to 360 divided by the numerical value of the angle at which the first side wall and the second side wall converge may be juxtaposed to form a generally cylindrical receptacle arrangement.

7. The receptacle of claim 6 wherein the angle upon which the first side wall and the second side wall converge is selected from the group consisting of approximately 90 degrees, approximately 120 degrees, and approximately 180 degrees.

8. The receptacle of claim 6 wherein the first side wall of the receptacle has an interior face with a groove and the second side wall of the receptacle has an interior face with a groove whereby a first receptacle may be juxtaposed against a second receptacle and a clip having a first tongue and a second tongue may be located such that the first tongue of the clip engages the groove in the first side wall of the first receptacle and the second tongue of the at least one clip may engage the groove in the second side wall of the second receptacle to hold the first receptacle and the second receptacle in a cohesive, juxtaposed relationship.

9. A kit of paint carrying receptacles for maintaining a multiplicity of paints separate within a compartmented receptacle arrangement wherein each receptacle is comprised of a generally planar first side wall, a generally planar second side wall, an arcing third side wall, and a bottom wall; wherein the first side wall and the second side wall of each receptacle have lengths which are substantially equal; wherein the first side wall, the second side wall, the third side wall, and the bottom wall of each receptacle are mutually sealingly engaged to create a wedge of a cylinder having a top opening and with the bottom wall comprising a bottom; wherein the first side wall and the second side wall of each receptacle converge upon a joint an angle of 180 degrees or less; and wherein the first side wall and the second side wall have heights that decline downwardly to the arcing third side wall from the joint where the first side wall joins the second side wall for better maintaining the separation of paints when a multiplicity of similar receptacles are juxtaposed to form a generally cylindrical receptacle arrangement whereby a multiplicity of similar receptacles may be juxtaposed to form a generally cylindrical receptacle arrangement with each receptacle comprising a compartment, each receptacle being capable of retaining a paint separately from the other receptacles, and each receptacle being capable of being selectively removed from the receptacle arrangement.

10. The kit of claim 9 wherein the numerical value of the angle upon which the first side wall and the second side wall of each receptacle converge enters 360 approximately a whole number of times whereby a number of receptacles equivalent to 360 divided by the numerical value of the angle at which the first side wall and the second side wall converge may be juxtaposed to form a generally cylindrical receptacle arrangement.

11. The kit of claim 10 wherein the angle upon which the first side wall and the second side wall converge is selected from the group consisting of approximately 90 degrees, approximately 120 degrees, and approximately 180 degrees.

12. The kit of claim 10 further including at least one clip having a first tongue and a second tongue and wherein the first side wall of each receptacle has an interior face with a groove and the second side wall of each receptacle has an interior face with a groove whereby the first tongue of the at least one clip may engage the groove in the first side wall of a first receptacle and the second tongue of the at least one clip may engage the groove in the second side wall of a juxtaposed second receptacle to hold the first receptacle and the second receptacle in a cohesive, juxtaposed relationship.

13. A compartmented paint carrying device for maintaining a multiplicity of paints separate within the device, the device comprised of a generally rigid container having a bottom wall, at least one side wall having an inside face and sealingly engaged with and extending upwardly from the perimeter of the bottom wall, a top opening, an open inner volume, and at least one irremovable dividing wall sealingly engaged with the at least one side wall and the bottom wall for dividing the open inner volume of the paint carrying device into at least two permanently separate compartments wherein the at least one irremovable dividing wall is generally planar and at least meets with a center axis of the device and wherein the at least one dividing wall has a height that declines downwardly from the center axis of the device to the at least one side wall.

14. The device of claim 13 wherein the bottom wall is generally round and there is one generally annular side wall whereby the device is generally cylindrical and the device has a center axis.

15. The device of claim 13 further comprising a means attached to the device for releasably retaining a paint brush.

16. The device of claim 15 wherein the paint brush retaining means is comprised of a generally C-shaped member attached to a wall of the device, the C-shaped member having an open interior whereby a paint brush having a handle with a distal portion thicker than a proximal portion may be retained releasably by the C-shaped member by passing the proximal portion of the handle into the open interior of the C-shaped member and resting the distal portion of the handle within the open interior of the C-shaped member.

17. The device of claim 13 wherein there are three dividing walls, and each dividing wall extends from the center axis of the device to the at least one side wall at an angle of approximately 120 degrees relative to an adjacent dividing wall whereby the device has three compartments.

18. The device of claim 13 wherein there are four dividing walls, and each dividing wall extends from the center axis of the device to the at least one side wall at an angle of approximately 90 degrees relative to an adjacent dividing wall whereby the device has four compartments.

* * * * *